United States Patent [19]

Inada et al.

[11] Patent Number: 4,787,200

[45] Date of Patent: Nov. 29, 1988

[54] RUBBER-REINFORCING AROMATIC POLYAMIDE FIBER CORDS

[75] Inventors: Norio Inada, Kodaira; Isamu Imai, Tokorozawa, both of Japan

[73] Assignee: Bridgestone Corporation, Tokyo, Japan

[21] Appl. No.: 62,982

[22] Filed: Jun. 17, 1987

[30] Foreign Application Priority Data

Jul. 24, 1986 [JP] Japan ..... 61-112658[U]

[51] Int. Cl.[4] ..... D02G 3/28; D02G 3/40; D02G 3/48

[52] U.S. Cl. ..... 57/242; 57/236; 57/902

[58] Field of Search ..... 57/211, 232, 241, 242, 57/236, 250, 251, 258, 295, 297, 58.52, 362, 902; 156/180, 296

[56] References Cited

U.S. PATENT DOCUMENTS

| | | | |
|---|---|---|---|
| 2,273,200 | 2/1942 | Hoff | 57/236 X |
| 3,597,303 | 8/1971 | Tanaka | 57/902 X |
| 3,977,172 | 8/1976 | Kerawalla | 57/242 X |
| 4,155,394 | 5/1979 | Shepherd et al. | 57/902 X |
| 4,389,839 | 6/1983 | van der Werff | 57/242 X |
| 4,435,236 | 3/1984 | Inae et al. | 57/902 X |
| 4,498,891 | 2/1985 | Mashimo et al. | 57/902 X |
| 4,652,252 | 3/1987 | Westhoff et al. | 57/237 X |
| 4,652,488 | 3/1987 | Willemsen et al. | 57/242 X |

*Primary Examiner*—Stuart S. Levy
*Assistant Examiner*—Joseph J. Hail, III
*Attorney, Agent, or Firm*—Sughrue, Mion, Zinn, Macpeak & Seas

[57] ABSTRACT

Rubber-reinforcing polyamide fiber cords are disclosed which are each obtained by primarily twisting an aromatic polyamide filament yarn, doubling a plurality of thus primarily twisted yarns and finally twisting doubled yarns in a twisting direction opposite to that of the primary twist yarn to obtain a plied yarn, and applying a rubber adhesive to the thus obtained plied yarn. N and M satisfy the following relation: $1.05 \leqq M/N \leqq 1.6$ in which N and M are the number of primary twists and the number of the twists in the cord, respectively.

3 Claims, 3 Drawing Sheets

RUBBER-REINFORCING AROMATIC POLYAMIDE FIBER CORDS

BACKGROUND OF THE INVENTION (1) Field of the Invention

The present invention relates to rubber-reinforcing aromatic polyamide fiber cords. More particularly, the invention relates to rubber-reinforcing aromatic polyamide fiber cords used as reinforcements in carcass layers and belt layers of tires, hoses, belts, etc.

(2) Related Art Statement

Heretofore, a majority of fiber-reinforcing rubber structures have been reinforced by fiber cords made of materials such as rayon, nylon, polyester, etc. Recently, aromatic polyamide fiber cords have begun to be used as reinforcements for rubber articles such as tires, hoses, belts, etc. This is because as compared with the conventional organic synthetic fibers, the aromatic polyamide fibers have higher tenacity, higher modulus, and excellent heat resistance and dimensional stability.

Although aromatic polyamide fibers have the above-mentioned merits, they have a demerit that they have far poorer compression fatigue resistance as compared with other organic synthetic fibers. Under the circumstances, research has been done to improve the compression fatigue resistance of the aromatic polyamide fibers. As one of coutermeasures, a method of increasing the number of twists of cords has conventionally been known. Indeed, the compression fatigue resistance is certainly improved by increasing the number of twists, but on the other hand, the tenacity of the cords is simultaneously lowered. Thus, there occurs a problem that the merit of the aromatic polyamide fibers have higher tenacity is reduced.

SUMMARY OF THE INVENTION

In order to solve the above-mentioned problems, the present inventors have noted the number of primary twists, N, (turns/10 cm) and the number of ply twists, M, (turns/10 cm) in a plied yarn used for the rubber-reinforcing cords, and have made various investigations. Formerly, the numbers of primary twists, N, and the number of ply twists, M, have generally been made equal to each other (N=M) in the plied yarns. That is, these plied yarns have been used in a form of so-called twist-balanced cords (N=M). Even when the number of twists are increased in such plied yarns, comparisons have been ordinarily made with respect to the increased number of twists while the relation of N=M being maintained. Under the circumstances, the present invention has been accomplished based on an acknowledgment that rubber-reinforcing aromatic polyamide fiber cords in which a cord tenacity equivalent to that of the conventional so-called twist-balanced cords (N=M) is maintained and compression fatigue resistance is largely improved can be obtained by specifying a ratio of M/N between the number of primary twists (N) and the number of ply twists (M) in the aromatic polyamide fiber cords in a specific range.

That is, the aromatic polyamide fiber cords according to the present invention are rubber-reinforcing cords which are prepared by primarily twisting an aromatic polyamide filament yarn, doubling a plurality of the thus obtained yarns, twisting the yarns in a twisting direction opposite to that of the primary twist yarn to obtain a plied yarn, and applying an appropriate rubber adhesive (adhesion for rubber goods) to the thus obtained plied yarn, and are characterized in that M and N meets the following inequations: $1.05 \leqq M/N \leqq 1.6$, and preferably, $1.1 \leqq M/N \leqq 1.35$ in which N and M are the number of primary twists (turns/10 cm) and the number of ply twists (turns/10 cm), respectively.

These and other objects, features and advantages of the present invention will be appreciated upon reading of the following description of the invention when taken in connection with the attached drawings, with understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached dawings, wherein:

FIG. 1(*b*) is a two folded twist yarn made from the primary twist yarns as shown in FIG. 1(*a*);

DETAILED DESCRIPTION OF THE INVENTION

The construction of the present invention will be explained in more detail with reference to the attached drawings.

Figure 1A:
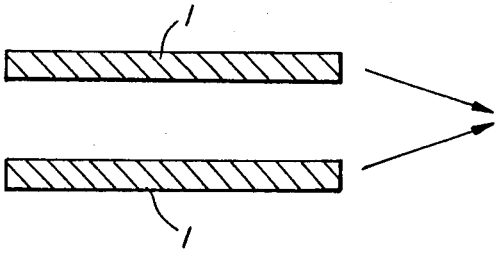
FIG. 1(*a*) is a side view of a primary twist yarn used for producing cords according to the present invention.
Figure 1B:
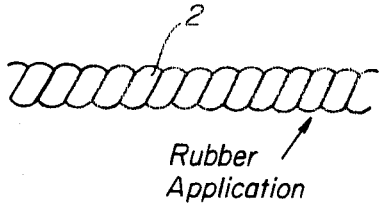

In FIG. 1(*a*) is shown a primary twist yarn which is obtained by first twisting an aromatic polyamide filament yarn and is used for the cords according to the present invention, and FIG. 1(*b*) shows a two folded yarn obtained by using two primary twist yarns shown in FIG. 1(*a*).

As the aromatic polyamide fibers used in the present invention, use may be preferably made of poly(1,4-phenylene terephthalamide), poly(1,4-benzamide), poly(1,3-phenylene isophthalamide),1,4-phenylene terephthalamide-3,4'-diaminodiphenyl ether copolymer or the like. The plied yarns are obtained by first twisting a filament yarn in an ordinary way, doubling thus obtained primary twist yarns (ordinarily two or three yarns) and finally twisting the doubled yarns in a twisting direction opposite to that of the primary twisting. In order to apply a rubber adhesive to the plied yarn, the yarn is pretreated with an appropriate adhesive, ordinarily with an epoxide base adhesive, an isocyanate base adhesive or the like and then treated with a conventional RFL (a mixture of a resorcin-formaldehyde initial stage condensate and rubber latex).

However, other adhesive and/or other treating method may be employed in the present invention so long as the rubber can be applied onto the yarns with good adhesion.

In general, when the rubber adhesive is to be applied to the cords, the fiber cords are heated and a tension is exerted thereonto. Thus, the cords expand or contract, so that the number of twists in the cord slightly varies between before and after the adhesive is applied. The adhesive-treated cord is then buried in an unvulcanized rubber and then converted to an article through vulcanization. Thus, change in the number of the twists during the bring and vulcanizing process is small. In actual, it may be considered that the numbers of twists before and after this process are substantially equal to each other. For this reason, the numbers of twists specified according to the present invention may be applied both to the dipped cords having undergone the adhesive application and the cords buried in the rubber composite body as article. The numbers of primary and ply twists are defined and measured as follows:

That is, assuming that a total denier of the cord is taken as D, the number of ply twists, M, is represented by a number of twists per 10 cm of a cord sample before ply twist yarns being untwisted under an initial stage load of D/20 (g). After the ply twist yarns becomes in parallel with each other or one another subsequent to the measurement of the number of ply twists, primary twist yarns are cut off excluding one primary twist yarn. Then, the initial stage load is changed to $D/20\times 1/n$ (g) in which n is the number of primary twists (two yarns twisting $n=2$, three yarns twisting $n=3$). The number of primary twists, N, is represented by the number of twists per 10 cm of the yarn in this state. With respect to the cords buried in the rubber composite article, an intended cord is extracted from the article and rubber attached around the cord is fully removed. Then, the numbers of primary and ply twists are measured in the above-mentioned ways.

The object of the present invention is accomplished on the basis of two grounds. One of them is the fact that there exists cords which have the $M/N>1.0$ and $M>M_o$ (the number of ply twists: M, and the number of primary twists, N) and maintain the same tenacity as that of twist-balanced cords in which $M_o=N_o$ (the number of ply twists: $M_o$ and the number of primary twists: $N_o$). The other is the fact that compression fatigue resistance has almost no relation to the number of the primary twists, N, and is mainly determined by the number of ply twists, M, and the compression fatigue resistance increases with increase in the number of ply twists, M. From these two facts, the cords with the number of ply twists (M) and the number of primary twists (N) in which the compression fatigue resistance is largely improved while the equivalent cord tenacity equivalent to the twist-balanced cords with the number of ply twist ($M_o$) and the number of primary twist ($N_o$) is maintained can be obtained to accomplish the object of the present invention. The upper limit of M/N of 1.6 which meets the object of the present invention is determined from experimental results shown in the following Examples, while the lower limit of 1.05 is defined as a limit which is well discernible in terms of obtained effects from the twist-balanced cords in the prior art.

The present invention will be explained in more detail with reference to the following Examples and Comparative Examples.

EXAMPLES 1 TO 10 AND COMPARATIVE EXAMPLES 1 TO 10

Poly(1,4-phenylene terephthalamide) (manufactured by Du pont, trade name: Kevlar) was used as an aromatic polyamide fibers. A filament yarn of 3000 D was primarily twisted, and such three twisted yarns were doubled and finally twisted and used at 3000 D/3. The thus twisted and plied yarns had the numbers of primary twists and the number of ply twists shown in Table 1, and were immersed in an aqueous solution of an epoxide compound, dried and thermally treated. Then, the yarns were immersed into an RFL liquid, and dried and thermally treated again, thereby obtaining an adhesive-treated cords (so-called dipped cords). The number of the ply twists, M, and the number of the primary twists, N, of the thus obtained dipped cords were measured in the above-mentioned ways. The tenacity (kg) at break of the dipped cords was measured at a sample length of 25 cm and a tensile pulling speed of 10 cm/min by using an Instron tensile tester.

Next, 0.5 mm thick sheets of an unvulcanized rubber mainly composed of natural rubber and having the following composition were bonded to opposite surfaces of the thus obtained dipped cords at an end count of 28 cords/5 cm, thereby obtaining a topping sheet having 5 cm width and 50 cm length.

| | parts by weight |
|---|---|
| Natural rubber | 100 |
| Carbon black HAF | 50 |
| Stearic acid | 2 |
| Zinc oxide | 8 |
| Vulcanization accelerator NOBS | 0.6 |
| Antioxidant, Suntflex 13 | 0.4 |
| Retarder | 0.4 |

Two topping sheets thus obtained were laminated one upon another via an unvulcanized rubber sheet of 1.5 mm in thick, and the unvulcanized rubber was bonded to the upper and lower surfaces thereof to give a total thickness of the whole sample being 10 mm. Then, vulcanization was carried out at 145° C. for 30 minutes under a pressure of 20 kg/cm$^2$, thereby obtaining a vulcanizate to be subjected to measurement of the compression fatigue resistance.

The sample was hanged through a pulley of a diameter of 20 mm while 50 kg weights were attached to opposite ends of the sample. The sample was reciprocated through the pulley at a cycle of a stroke of 120 mm and 5,000 times per hour to impart repeated flex thereupon. The sample was removed after 10,000 times flexing, cords near a contact surface to the pulley were removed, and tenacity (kg) at break was measured in the above-mentioned manner.

Figure 2:
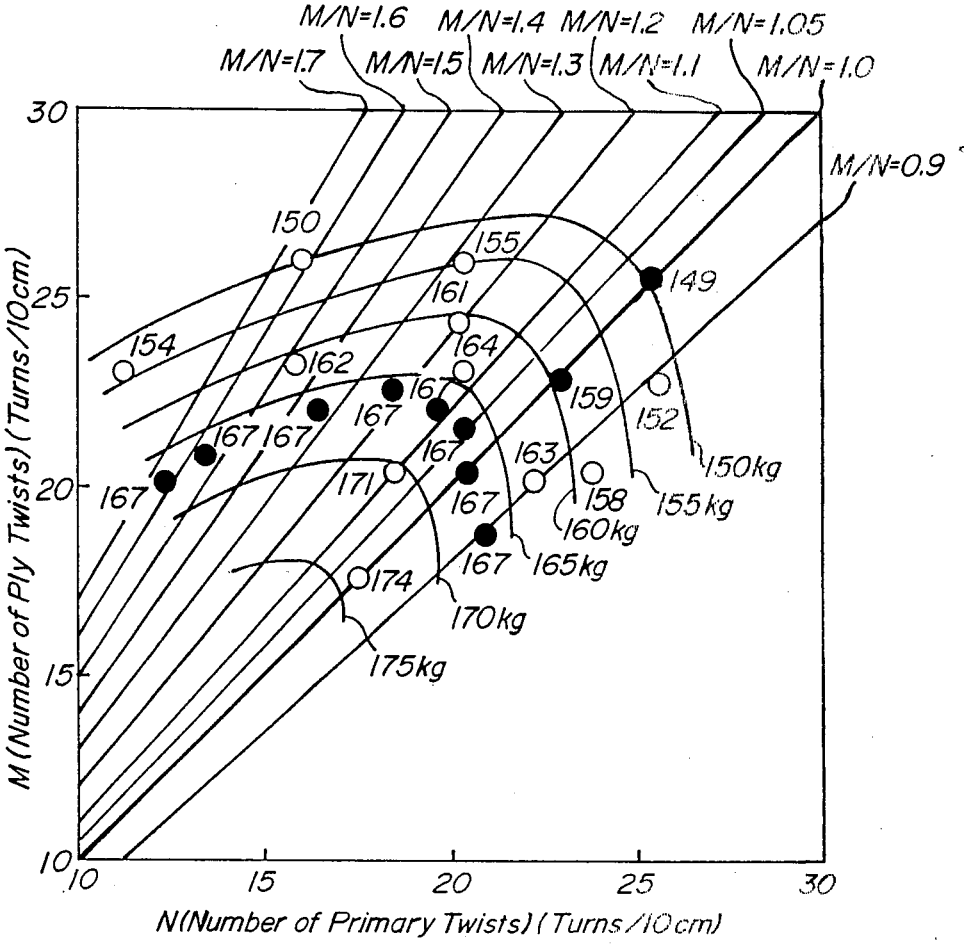
FIG. 2 is a graph showing the relation among the number of primary twists, the number of ply twists and tenacity (kg) at break in dipped cords.

The tenacity at break of twenty one dipped cords having the numbers of primary twists and ply twists were shown in FIG. 2.

As the numbers of primary and ply twists, (N and M) decrease, the tenacity of the dipped cords increases. That is, the tenacity goes left downwardly from the right upward area in FIG. 2. In the case of the conventional twist-balanced cords ($M=N$), the tenacity increases along a diagonal line (in which $M/N=1.0$) in FIG. 2. From the tenacities of the twenty one dipped cords, the contour lines of the tenacity were presumably drawn as shown in FIG. 2, and lines connecting ridges of the contour lines slightly deviate from a diagonal line of $M/N=1.0$ to near $M/N=1.1$ to 1.2. It is seen from FIG. 2 that the cords in which $M/N>1.0$ and $M>M_o$ while the tenacity equivalent to that of the conventional so-called twist balance cords having $M_o=N_o$ (points on the diagonal line in FIG. 2) is maintained. That is, points shifted left upwardly along the contour line of the tenacity from a point on the diagonal line in FIG. 2 have only to be considered.

Figure 3:
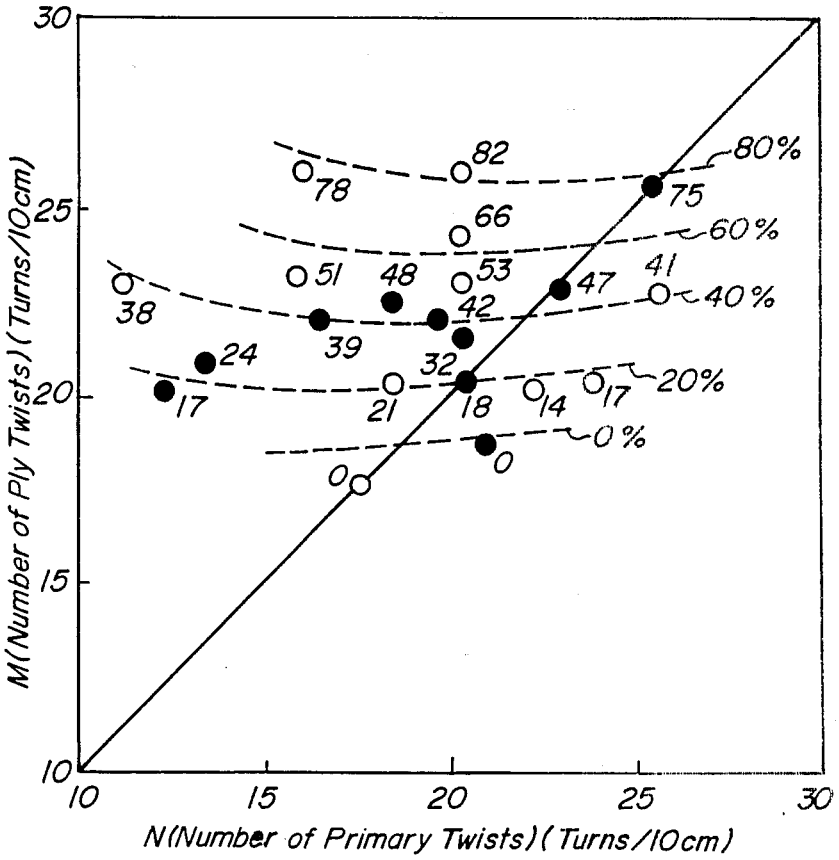
FIG. 3 is a graph showing the relation among the number of primary twists, the number of ply twists, and a tenacity-maintaining percentage after compression fatigue.

On the other hand, a so-called tenacity-maintaining percentage (%) after compression fatigue which is obtained by dividing the tenacity of each of the twenty one cords having various numbers of the primary and ply twists after the compression fatigue in the above-mentioned manner by the tenacity of the dipped cord and then multiplying a quotient by 100 is shown in FIG. 3. Thus, the percentage has no relation to the number of primary twists, N, and is mainly determined by the number of ply twists, M. It is understood that with an increase in the number of ply twists, M, the tenacity-maintaining percentage after the compression fatigue also increases.

The object of the present invention can be attained based on the above-mentioned two facts. Ten Examples, that is, Examples 1 to 5 and Comparative Examples 1 to 5, which are marked by black dots in FIGS. 2 and 3, are detailed in Table 1. With respect to Comparative Example 1, when the number of twists in the cord is increased as in the case of Comparative Examples 2 and 3 while $M/N=1.0$ is maintained, the tenacity-maintaining percentage after compression fatigue becomes certainly higher and the compression fatigue resistance is enhanced. On the other hand, the tenacity of the dipped cords decreases. Thus, the object of the present invention cannot be attained. As in the case of Examples 1 to 5 according to the present invention, when N is decreased and M is increased as compared with Comparative Example 1 to attain $1.05 \leqq M/N \leqq 1.6$, it is recognized that the tenacity-maintaining percentage after the compression fatigue becomes higher than that of Comparative Example 1 without damaging the tenacity of the dipped cords and the compression fatigue resistance is enhanced. More preferably, the effects are conspicuous in Examples 2 to 4 in which $1.1 \leqq M/N \leqq 1.35$.

On the other hand, when M/N is less than 1.6 as in Comparative Example 4, the effect of improving the tenacity-maintaining percentage after the compression fatigue cannot be seen as compared with Comparative Example 1 although the tenacity is equivalent to the that of Comparative Example 1, so that, the object of the present invention cannot be realized.

To the contrary, in the case of Comparative Example 5 having the tenacity of the dipped cords as in Comparative Example 1 is employed while $M/N<1.0$ in which the number of ply twists is smaller than the number of primary twists, the object of the present invention cannot be accomplished due to poorer compression fatigue resistance.

TABLE 1

| | Comparative Example 1 | Comparative Example 2 | Comparative Example 3 | Example 1 | Example 2 | Example 3 | Example 4 | Example 5 | Comparative Example 4 | Comparative Example 5 |
|---|---|---|---|---|---|---|---|---|---|---|
| Dipped cord | | | | | | | | | | |
| Tenacity (kg) | 167 | 159 | 149 | 167 | 167 | 167 | 167 | 167 | 167 | 167 |
| Number of primary twists N (turn/10 cm) | 20.4 | 22.9 | 25.4 | 20.3 | 19.6 | 18.4 | 16.4 | 13.4 | 12.3 | 20.9 |
| Number of ply twists M (turn/10 cm) | 20.3 | 22.8 | 25.5 | 21.5 | 22.0 | 22.5 | 22.0 | 20.8 | 20.1 | 18.7 |
| M/N | 1.00 | 1.00 | 1.00 | 1.06 | 1.12 | 1.22 | 1.34 | 1.55 | 1.63 | 0.89 |
| Tenacity after compression fatigue test (kg) | 30 | 75 | 112 | 54 | 70 | 80 | 65 | 40 | 29 | 0 (broken) |
| Tenacity-maintaining percentage after compression fatigue test (%) | 18 | 47 | 75 | 32 | 42 | 48 | 39 | 24 | 17 | 0 |

Figure 4:
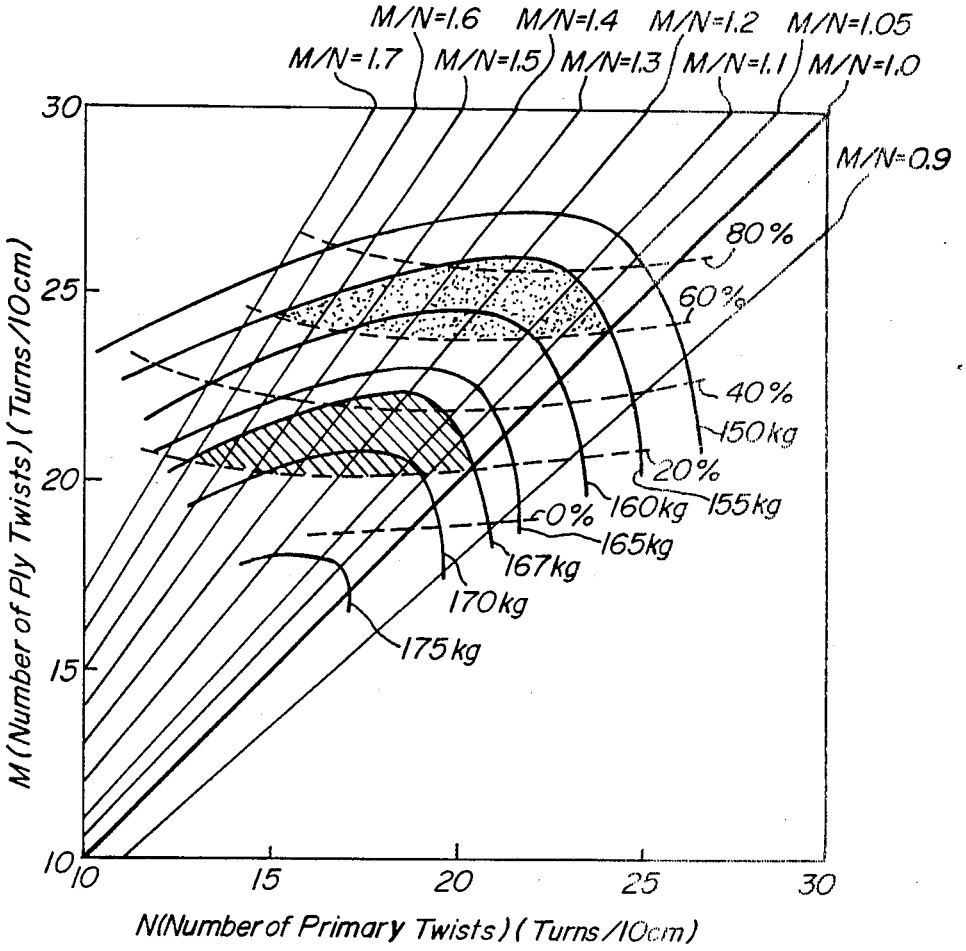
FIG. 4 is a graph uniting those of FIGS. 2 and 3 together.

In order to explain the present invention in a more understandable manner, the graphs in FIGS. 2 and 3 are overlapped in FIG. 4. In FIG. 4, dots in a shadowed zone meets the tenacity of the dipped cords is not less than 167 kg and that the tenacity-maintaining percentage after the compression fatigue is not less than 20% and the cords have not less than a tenacity in Comparative Example 1 while the compression fatigue resistance is improved.

In the similar way, a zone of cords which meet that the tenacity of the dipped cord is not less than 155 kg and the tenacity-maintaining percentage after the compression fatigue is not less than 60% is shown as a dotted area in FIG. 4. With respect to the twist-balance cords (positioned on points on the diagonal line in FIG. 4) in which $M_o=N_o$ in which $M_o$ and $N_o$ are the number of ply twists and the number of primary twists, respectively, the zone of the cords that realize the object of the present invention can be determined. The cords which satisfy the requirements according to the present invention fall inside this zone.

Next, cords having different deniers and different number of twists from those of the cords according to the present invention will be exemplified, and the generality of the present invention will be shown. As in the case of the above-mentioned Kevlar 3000 D/3, dipped cords of Kevlar 1500 D/2 having been subjected to the twisting, and adhesive application, that is, the dipped cords in Examples 6 to 10 and Comparative Examples 6 to 10 were prepared, and the numbers of primary and ply twists and the tenacity at break were measured. Furthermore, a vulcanizate to be used for the measurement of the compression fatigue resistance was prepared by changing the end count to 50 cords/5 cm according to the same method as mentioned above. The thus obtained sample was hanged through a pulley of 20 mm in diameter, and flexural force was repeatedly applied thereto in the same manner as mentioned in the above. The tenacity of the cords on the compression side after 20,000 times flexural bending was measured also in the similar way as mentioned above. Results are shown in Table 2.

TABLE 2

| | Comparative Example 6 | Comparative Example 7 | Comparative Example 8 | Example 6 | Example 7 | Example 8 | Example 9 | Example 10 | Comparative Example 9 | Comparative Example 10 |
|---|---|---|---|---|---|---|---|---|---|---|
| Dipped cord | | | | | | | | | | |
| Tenacity (kg) | 48.2 | 45.7 | 43.1 | 48.2 | 48.2 | 48.2 | 48.2 | 48.2 | 48.2 | 48.2 |
| Number of primary twists N (turn/10 cm) | 32.6 | 36.3 | 40.3 | 32.3 | 31.8 | 29.6 | 26.1 | 21.0 | 19.8 | 33.2 |
| Number of ply twists M (turn/10 cm) | 32.5 | 36.2 | 40.2 | 34.1 | 35.1 | 36.1 | 35.0 | 33.1 | 32.0 | 30.3 |
| M/N | 1.00 | 1.00 | 1.00 | 1.06 | 1.10 | 1.22 | 1.34 | 1.58 | 1.62 | 0.91 |
| Tenacity after compression fatigue test (kg) | 25.6 | 38.9 | 42.0 | 32.5 | 39.7 | 42.2 | 37.9 | 28.9 | 22.5 | 13.9 |
| Tenacity-maintaining percentage after compression fatigue test (%) | 53 | 85 | 97 | 67 | 82 | 88 | 79 | 60 | 47 | 29 |

As compared with Comparative Example 6, the tenacity-maintaining percentage after the compression fatigue becomes higher and the compression fatigue resistance increases when the number of twists in the cord is increased while $M/N=1.0$ is maintained as in Comparative Examples 7 and 8. On the other hand, however, the tenacity of the dipped cords decreases, so that the object of the present invention cannot be accomplished.

If the range of $1.05 \leqq M/N \leqq 1.6$ is realized by increasing M and decreasing N in Comparative Example 6 as in the case of Examples 6 to 10 according to the present invention, it is recognized that the tenacity-maintaining percentage after the compression fatigue becomes higher than that in Comparative Example 6 and the compression fatigue resistance is improved without damaging the tenacity of the dipped cord. These effects are more conspicuous in the case of Examples 7 and 8 in which M/N is in a preferable range of $1.1 \leqq M/N \leqq 1.35$. When $M/N > 1.6$ as in Comparative Example 9, the effect of improving the tenacity-maintaining percentage after the compression fatigue can be not be observed as compared with Comparative Example 6 although the tenacity of the dipped cords is the same as the Comparative Example 6. Thus, the object of the present invention cannot be realized. To the contrary, in Comparative Example 10 having $M/N < 1.0$ in which the number of ply twists is smaller than the number of primary twists and the tenacity of the dipped cord equivalent to that in Comparative Example 6, the compression fatigue resistance is rather poorer so that the object of the present invention cannot be attained.

As explained in the above Examples and Comparative Examples, the present invention can provide the rubber-reinforcing cords of aromatic polyamide fibers in which the tenacity of the cords equivalent to that the conventional twist-balanced cords ($N=M$) is maintained and the compression fatigue resistance is largely improved by specifying the ratio of M/N between the number of primary twists, N, and the number of ply twists, M, of the cords of the aromatic polyamide fibers in a constant range.

What is claimed is:

1. A rubber-reinforcing polyamide fiber cord which is obtained by primarily twisting an aromatic polyamide filament yarn, doubling a plurality of thus primarily twisted yarns and finally twisting doubled yarns in a twisting direction opposite to that of the primary twist yarn to obtain a plied yarn, and applying a rubber adhesive to the thus obtained plied yarn, wherein N and M satisfy the following equation; $1.05 \leqq M/N \leqq 1.6$ in which N and M are the number of primary twists and the number of the ply twists in the cord respectively, where M is the number of twists per 10 cm of cord before ply twist yarns being untwisted under an initial load in grams of Denier/20 and N is the number of twists per 10 cm under a load in grams of Denier/20 × 1/number of primary twists.

2. A rubber-reinforcing polyamide fiber cord according to claim 1, wherein N and M satisfy the following relation: $1.1 \leqq M/N \leqq 1.35$.

3. A rubber-reinforcing polyamide fiber cord according to claim 1, wherein the aromatic polyamide fiber is one selected from the group consisting of poly(1,4-phenylene terephalamide), poly(1,4-benzamide), poly(1,39-phenylene isophthalamide) and 1,4-phenylene terephthalamide-3,4'-diaminodiphenyl ether copolymer.

* * * * *